US009173438B2

(12) United States Patent
Blumenfeld

(10) Patent No.: US 9,173,438 B2
(45) Date of Patent: Nov. 3, 2015

(54) REUSABLE RASH PREVENTING SHIN GUARD SYSTEM

(76) Inventor: Annie Morgan Blumenfeld, Fairfield, CT (US)

( * ) Notice: Subject to any disclaimer, the term of this patent is extended or adjusted under 35 U.S.C. 154(b) by 876 days.

(21) Appl. No.: 13/400,928

(22) Filed: Feb. 21, 2012

(65) Prior Publication Data

US 2013/0218105 A1 Aug. 22, 2013

(51) Int. Cl.

*A61M 35/00* (2006.01)
*A41D 13/05* (2006.01)
*A63B 71/12* (2006.01)

(52) U.S. Cl.

CPC ..... *A41D 13/0543* (2013.01); *A63B 71/1225* (2013.01); *A63B 2071/1258* (2013.01); *A63B 2071/1275* (2013.01); *A63B 2243/005* (2013.01); *A63B 2243/0025* (2013.01); *A63B 2243/0041* (2013.01); *A63B 2243/0045* (2013.01)

(58) Field of Classification Search

None

See application file for complete search history.

(56) References Cited

U.S. PATENT DOCUMENTS 2,696,011 A * 12/1954 Galdik ..... 623/33
3,135,964 A * 6/1964 Pender ..... 2/22
4,001,953 A 1/1977 Fugere et al.
4,306,315 A 12/1981 Castiglia
4,344,189 A * 8/1982 Futere et al. ..... 2/16
4,669,126 A * 6/1987 Jones ..... 2/22
4,700,406 A * 10/1987 Meistrell ..... 2/22
4,756,026 A * 7/1988 Pierce, Jr. ..... 2/16
4,888,826 A * 12/1989 Parsons et al. ..... 2/22
4,926,501 A 5/1990 Goosen
5,031,904 A * 7/1991 Solloway ..... 482/111
5,301,370 A * 4/1994 Henson ..... 2/22
5,314,496 A * 5/1994 Harris et al. ..... 623/31
5,446,926 A * 9/1995 Bourque et al. ..... 2/22
5,450,625 A 9/1995 Hu
5,480,646 A * 1/1996 Vu ..... 424/443
5,529,987 A * 6/1996 Gallina ..... 514/54
5,581,817 A * 12/1996 Hicks ..... 2/239
5,617,580 A * 4/1997 DiCesare et al. ..... 2/22
D392,074 S * 3/1998 Witkin ..... D29/122
5,784,715 A * 7/1998 Buchanan ..... 2/22
5,829,055 A * 11/1998 Collins et al. ..... 2/22
5,842,475 A * 12/1998 Duback et al. ..... 128/846
5,926,844 A * 7/1999 Bear ..... 2/22
5,979,006 A * 11/1999 Stokes et al. ..... 15/222
6,029,273 A 2/2000 McCrane
6,105,164 A 8/2000 Huang
6,131,195 A 10/2000 Foreman
6,149,934 A * 11/2000 Krzysik et al. ..... 424/443
6,226,796 B1 5/2001 Tollini
6,402,712 B1 6/2002 Gauvry
7,032,246 B1 4/2006 LeMire
7,900,270 B2 3/2011 Scheffer
2001/0031249 A1* 10/2001 Oku et al. ..... 424/65
2002/0173738 A1* 11/2002 Rogalski ..... 602/21
2002/0184693 A1 12/2002 Beland
2002/0192268 A1* 12/2002 Alwattari et al. ..... 424/443
2003/0014001 A1* 1/2003 Martin ..... 602/27
2003/0167548 A1 9/2003 LaShoto et al.
2005/0114976 A1* 6/2005 Beland et al. ..... 2/22
2005/0199741 A1* 9/2005 Thomson ..... 239/36
2007/0071797 A1* 3/2007 Hernandez-Munoa et al. ..... 424/443

(Continued)

*Primary Examiner* — Lynne Anderson
*Assistant Examiner* — Paula L Craig
(74) *Attorney, Agent, or Firm* — Paul, Weiss, Rifkind, Wharton & Garrison LLP

(57) ABSTRACT

The invention relates to a shin guard system for sporting activities that have a shin guard portion and a reusable elastic rash and odor preventing insert attached thereto.

7 Claims, 4 Drawing Sheets

(56) References Cited

U.S. PATENT DOCUMENTS

| | | | | |
|---|---|---|---|---|
| 2007/0101475 | A1* | 5/2007 | Skottheim | 2/69 |
| 2007/0214538 | A1* | 9/2007 | Castonguay et al. | 2/22 |
| 2007/0294799 | A1 | 12/2007 | Pedigo et al. | |
| 2008/0016605 | A1* | 1/2008 | Wong | 2/466 |
| 2008/0113143 | A1* | 5/2008 | Taylor | 428/47 |
| 2008/0201814 | A1* | 8/2008 | Goyer et al. | 2/22 |
| 2008/0226701 | A1* | 9/2008 | Deignan et al. | 424/449 |
| 2009/0077707 | A1* | 3/2009 | Scheffer | 2/22 |
| 2009/0205097 | A1* | 8/2009 | Manning et al. | 2/22 |
| 2009/0235938 | A1* | 9/2009 | Roach | 128/891 |
| 2010/0016790 | A1* | 1/2010 | Peters | 604/82 |
| 2010/0043123 | A1* | 2/2010 | Goodhand et al. | 2/228 |
| 2010/0166832 | A1* | 7/2010 | Ingle et al. | 424/443 |
| 2010/0192269 | A1* | 8/2010 | Saranga | 2/24 |
| 2011/0307998 | A1* | 12/2011 | Turner | 2/455 |
| 2012/0102613 | A1* | 5/2012 | Loth et al. | 2/22 |
| 2012/0129418 | A1* | 5/2012 | Ingle | 442/371 |
| 2012/0180182 | A1* | 7/2012 | Wade | 2/22 |
| 2013/0198922 | A1* | 8/2013 | Wittman | 2/22 |

* cited by examiner

REUSABLE RASH PREVENTING SHIN GUARD SYSTEM

FIELD OF THE INVENTION

The present invention relates to a reusable elastic rash preventing insert for use with shin guards, and a shin guard system incorporating said reusable elastic rash preventing insert.

BACKGROUND OF THE INVENTION

In sporting activities such as soccer, ice hockey, field hockey, and lacrosse, athlete's shins and ankles are prone to injury from impact. To prevent such injuries, athletes use shin guards for protection. Although prior art shin guards are generally designed to protect a player's lower leg and ankle from impact with a ball, a puck, an opposing player's foot, and other sporting equipment, shin guards can provide great discomfort to the player. Prior art shin guards are generally formed with an impact absorbing material, including, for example, plastics, foams, carbon fiber, and impact-absorbing gels, that are encased and/or backed with a fabric or other synthetic material. These shin guards are designed to be worn inside a player's sock, wherein the inside surface of the backing or casing directly contacts the player's lower leg. The shin guard is secured to the player's lower leg by means of a strap extending around the leg. Players often sweat during play, particularly in the area between the shin and the backing or casing of the shin guard. As this backing or casing rubs against a player's shin during play, the player's skin is irritated and may develop a rash. Moreover, some of the player's sweat penetrates into and is absorbed by the backing or casing of the shin guard, resulting in foul odors after play. Washing and drying these shin guards can be difficult, as high temperatures can deform or destroy the impact absorbing material. Multiple washes can also lead to deterioration of the shin guards.

Attempts have been made to overcome some of the problems associated with prior art shin guards. For example, U.S. Pat. No. 7,900,270 to Scheffer (hereinafter the "270 patent") discloses a shin guard for a soccer player that comprises a bandage with straps surrounding a player's lower leg, and a rigid shield element attached thereto that is intended to be positioned in front of the player's shin. The bandage is attached to the rigid shield element with Velcro® hook and loop fabric fastener, and is removable from the shield element. This construction, however, has multiple drawbacks. For example, the bandage layer is bulky and constrictive on the player's leg. The bandage layer has two constrictive straps for attachment to the player's leg, which are formed from two upper flaps that wrap around the player's leg and attach to one another above the player's calf, and two lower flaps that wrap around the player's leg and attach to one another below the player's calf. In addition, the shin guard described in the '270 patent has no means of securing the rigid shield element to the player's leg. The rigid shield element is only attached by Velcro® to the underlying bandage layer. As such, the rigid shield element may become dislodged from the shin area when in use, thereby heightening the risk of injury to the player. Moreover, the shin guard described in the '270 patent is an integrated system that requires a rigid shield element that is specifically designed for attachment to the bandage layer. The bandage layer is not designed to be interchangeable with other types of impact absorbing constructions. Finally, for ankle protection, the shin guard described in the '270 patent requires a separate ankle guard that the player attaches with Velcro® to the elastic bandage layer. This construction is prone to detachment during use, which may limit the shin guard's effectiveness.

U.S. Patent Application Publication No. 2007/0294799 to Pedigo et al. (hereinafter the "'799 application"), now abandoned, describes a shin guard odor protector comprising an absorbent pad, a protective barrier material, and a fastening system designed to be temporarily attached to a shin guard. The '799 application contends that the odor protector described therein absorbs the wearer's perspiration, protects the shin guard from that perspiration, and is removed and discarded after use. The odor protector described in the '799 application is not washable or reusable, which results in high replacement costs over the life of a shin guard. Moreover, the odor protector is backed by a plastic barrier material layer that imparts rigidity into the overall structure (i.e., the odor protector is inelastic). The odor protector's rigidity is augmented by the series of attachment means, namely adhesive strips, that extend along the length of the odor protector at intervals across the entirety of the protective barrier layer. This rigidity may cause rashes on a player's shin during play.

The present invention has been designed to overcome these and other deficiencies in the prior art.

SUMMARY OF THE INVENTION

The present invention is a reusable elastic rash preventing insert for use with shin guards, and a shin guard system incorporating said reusable rash preventing insert.

The present invention overcomes the deficiencies of the prior art by providing a reusable elastic rash preventing insert that is easily interchangeable with a variety of known shin guards. The inventive insert can be attached to the backing or casing of a shin guard prior to play, detached and washed after play, and then reattached to the backing or casing of the shin guard for the next game or match. The insert is designed to wick away and absorb sweat from a player's shin while also providing a high level of comfort that prevents the formation of rashes. This balance between sweat absorbency and comfort is achieved by use of a specific material construction sized to attach only to the backing or casing of the shin guard. The insert is generally constructed of a uniform elastic fabric material provided in one or more layers.

The inventive insert can be formed in various shapes and sizes such that the insert covers a substantial portion of the back surface of a standard sized child or adult shin guard. The inventive insert is preferably used with shin guards that comprise a uniform shin and ankle guard construction, but may also be used with shin guards that only cover a player's shin, and do not have an ankle guard attached thereto. Because the inventive insert can be sized to fit standard shin guards, there is no need to purchase a new shin guard after purchasing the inventive insert. Rather, the inventive insert can be adapted to fit within a previously used shin guard, or a new shin guard if desired. In a preferred embodiment, the width of the inventive insert is equal to or less than the width of the back surface of the shin guard.

The inventive insert includes attachment means that attach the insert to the backing or casing of the shin guard. The backing or casing of the shin guard may also be modified to include attachment means to facilitate attachment of the insert. For example, in a preferred embodiment, a hook and loop (Velcro®) type attachment means is used, wherein one side of the hook and loop attachment means is secured along the inventive insert, and the other side of the hook and loop attachment means is secured along the casing or backing of the shin guard. This preferred construction permits attachment, repositioning, and removal of the inventive insert from the casing or backing of the shin guard. It is also preferred that the attachment means are affixed only in the vicinity of the longitudinal edges of the inventive insert and the backing or casing of the shin guard. By leaving the middle portion of the inventive insert free of attachment means, the inventive insert maintains its elastic character and better conforms to the player's shin, thereby reducing the risk of rash formation. In alternative embodiments, the attachment means may comprise adhesive material, snap-type fittings, or other mechanical attachment mechanisms known to those of ordinary skill in the art. When adhesive material is used, a removable protective lining may be used to protect the adhesive prior to attachment.

In a preferred embodiment, the inventive insert comprises a uniform material construction formed of (1) a blend of nylon and elastane; (2) a blend of nylon, elastane, and polyester; or (3) 100% polyester. When a nylon/elastane blend is used, the uniform material construction preferably comprises 75-95% nylon and 5-25% elastane, most preferably 80-85% nylon and 15-20% elastane. When a nylon/elastane/polyester blend is used, the uniform material construction preferably comprises 60-75% nylon, 10-20% elastane, and 15-30% polyester, most preferably 60-65% nylon, 10-15% elastane, and 20-25% polyester.

The inventive insert may comprise a single layer or multiple layers of the uniform material construction. When multiple layers of the uniform material construction are used, the layers may be attached together by any suitable means known in the art, most preferably by sewing the layers together with thread. The material construction of the insert is sweat absorbent, prevents rashes when used, and is washable. Moreover, the absence of an additional plastic or other rigid, non-porous barrier layer maximizes elasticity and comfort for the player.

In an alternative embodiment, the inventive insert may be impregnated with a lotion or powder with moisturizing and/or antihistaminic properties. Likewise, in an alternative embodiment, any other material construction for the inventive insert may be selected by one of ordinary skill in the art insofar as the material construction provides the requisite level of sweat absorption, is sufficiently soft and elastic to prevent rashes from forming on a player's shin during a game or match, and is both washable and reusable.

In a preferred embodiment, the shin guard construction has an elastic strap that wraps around a player's leg and permits secure attachment of the shin guard, including its impact absorbing layer, to the player's shin. In this preferred embodiment, a player attaches the inventive insert to the backing or casing of the shin guard, and then wraps the elastic strap around his or her leg. This provides a secure attachment of the impact absorbing layer along the player's shin without requiring separate attachment means to attach the inventive insert to the player's leg. Rather, the attachment means between the inventive insert and the backing or casing of the shin guard are sufficiently strong to prevent dislodgement of the inventive insert from the shin guard during play. In an alternative embodiment, the shin guard construction and inventive insert may also be friction fit against a player's leg without the need for an elastic strap that wraps around the player's leg.

While the above description is limited to shin guards, it is noted that the inventive insert may be readily adapted for use with other protective sporting equipment, such as knee pads and elbow pads.

The present invention can be further understood through the following description and accompanying drawings, which are only schematic and not necessarily proportional and/or scalable.

DETAILED DESCRIPTION OF THE PREFERRED EMBODIMENTS

Figure 1:
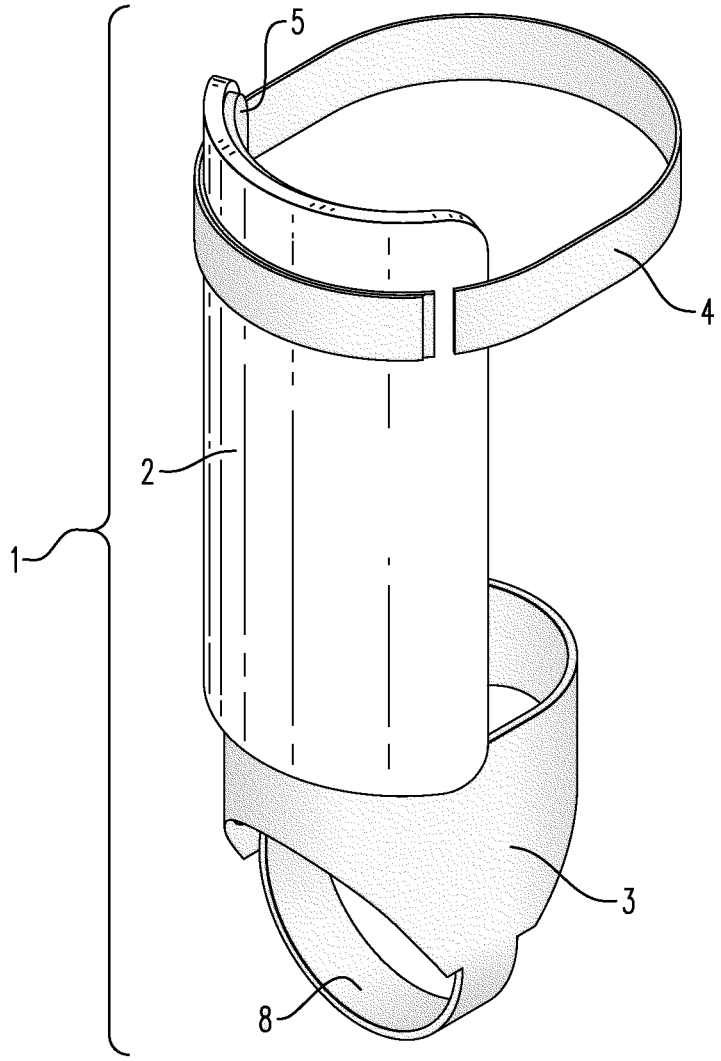
FIG. 1 is a front view of a preferred embodiment of a shin guard portion of a shin guard system.

FIG. 1 illustrates the front of the shin guard portion (1) of the shin guard system of the preferred embodiment. The shin guard portion (1) comprises an impact absorbing layer (2) that absorbs and distributes impact from a ball, a puck, an opposing player's foot, and other sporting equipment during play. The impact absorbing layer (2) may be formed with any known impact absorbing material in the art, including, but not limited to, plastic, foam, carbon fiber, and/or impact-absorbing gels. The impact absorbing layer (2) is backed with a backing layer (5). The shin guard portion (1) further comprises an elastic leg strap (4) that is secured in part along the impact absorbing layer (2). When in use, a player wears the shin guard system under a sock, and wraps the elastic leg strap (4) around the leg just above the calf. The impact absorbing layer (2) is thereby secured along the shin of the player for the duration of the game or match. The shin guard portion (1) further comprises an ankle protector (3) securely attached and/or integral with the impact absorbing layer (2) and/or backing layer (5). The ankle protector (3) protects a player's ankle from impact during play. The ankle protector (3) is formed by any known method in the art, including encasing impact absorbing material in a fabric-based ankle protector that is integral with or securely attached to the shin-protecting region of the shin guard portion (1). The ankle protector (3) preferably has an elastic strap (8) connected thereto that wraps around a players foot and helps maintain the shin guard system in place during play.

Figure 2:
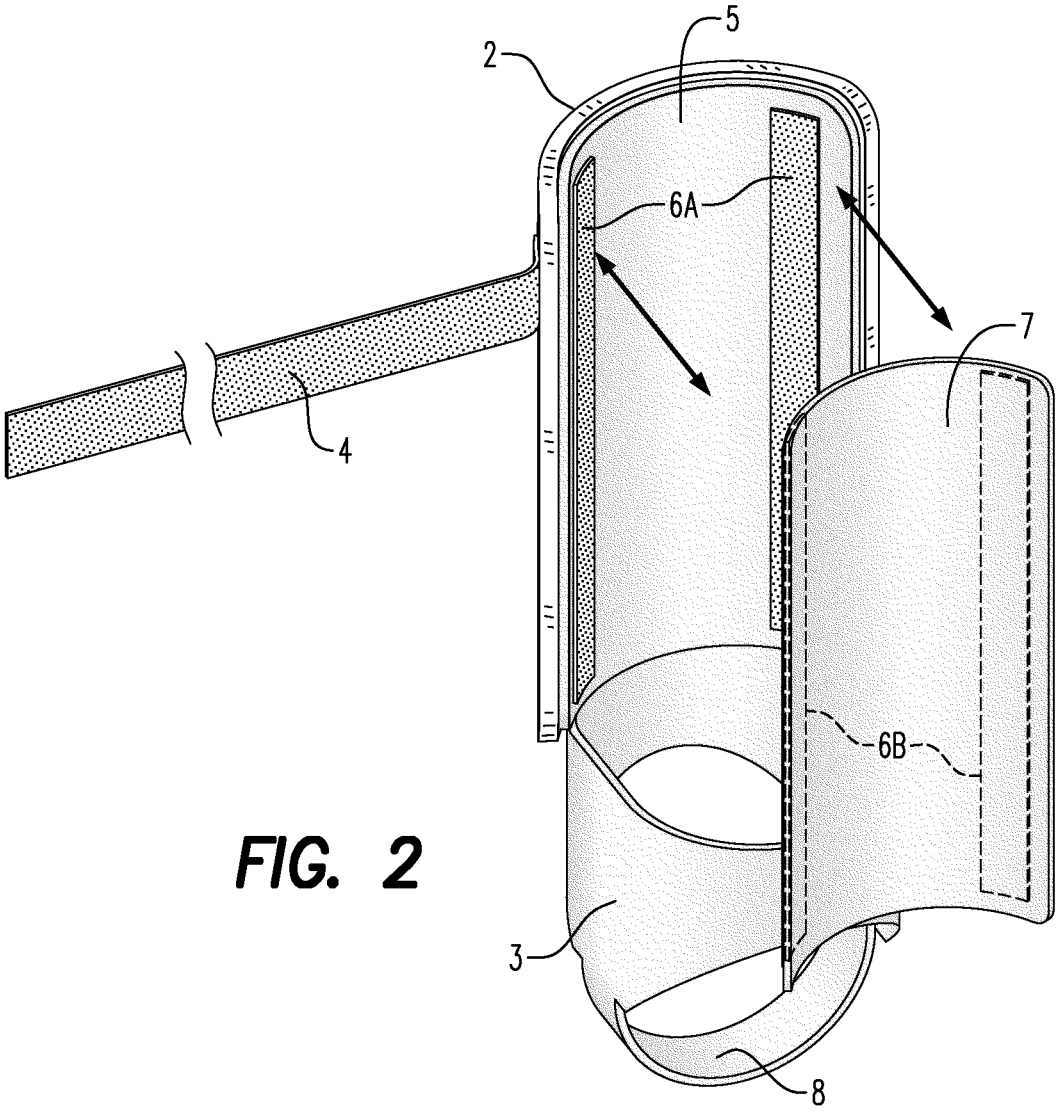
FIG. 2 is a back view of a preferred embodiment of a shin guard portion prior to attachment of an elastic rash preventing insert thereto.

FIG. 2 illustrates the back of the shin guard portion (1) of the shin guard system of the preferred embodiment. Here, the backing layer (5) can be seen, which extends along the back surface of the impact absorbing layer (2). As noted above, the backing layer (5) can be formed from any fabric or synthetic material known in the art. Although backing layer (5) is described herein as a layer that extends along the back of the impact absorbing layer, it is understood by the inventor that this layer can also extend along the front of the impact absorbing layer, thereby encasing the impact absorbing layer in the fabric or synthetic material layer. Also shown in FIG. 2 are the elastic leg strap (4), the ankle protector (3), and the elastic foot strap (8). In this preferred embodiment, attachment means (6A) are attached only in the vicinity of the longitudinal edges of the backing layer (5). The attachment means (6A) of the preferred embodiment are one side of a hook and loop (Velcro®) attachment means, wherein the other side of the hook and loop attachment means (6B) is attached to the reusable elastic rash preventing insert (7). As noted above, although the attachment means (6A) is preferably a hook and loop (Velcro®) attachment means, other attachment systems, including, but not limited to, adhesive or clip-type attachment means, may be used. Where an adhesive attachment means is used, a removable protective liner may be used to protect the adhesive prior to use.

Figure 3:
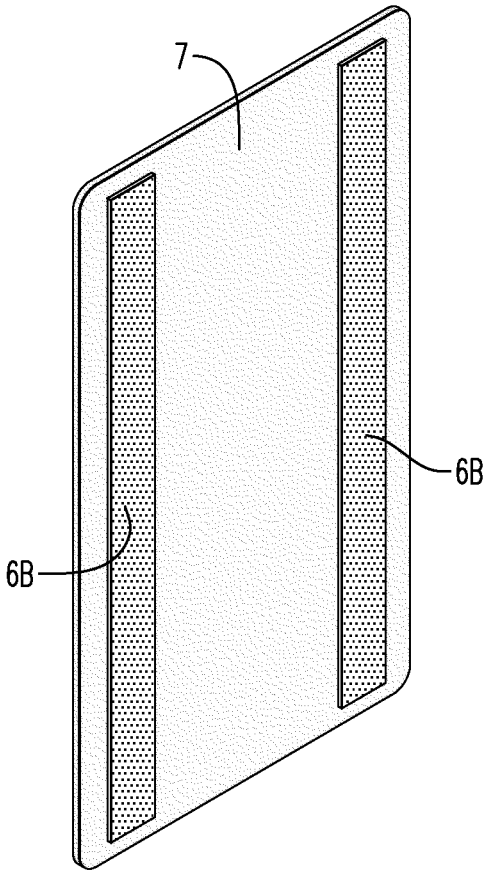
FIG. 3 is a front view of a preferred embodiment of a reusable elastic rash preventing insert.
Figure 4:
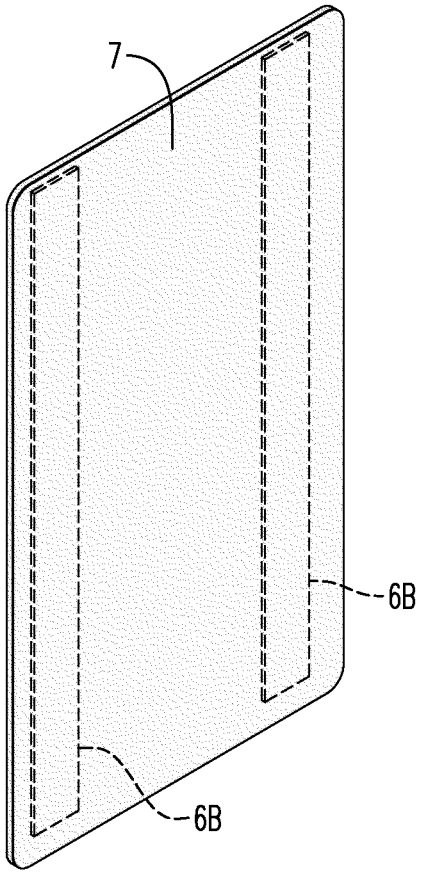
FIG. 4 is a back view of a preferred embodiment of a reusable elastic rash preventing insert.

FIGS. 3-4 illustrate front and rear views, respectively, of the preferred embodiment of the reusable elastic rash preventing insert (7). The reusable elastic rash preventing insert (7) can be formed with a variety of material compositions. Preferably, the reusable elastic rash preventing insert (7) is formed with a uniform material construction comprising: (1) a blend of nylon and elastane; (2) a blend of nylon, elastane, and polyester; or (3) 100% polyester. When a nylon/elastane blend is used, the uniform material construction preferably comprises 75-95% nylon and 5-25% elastane, most preferably 80-85% nylon and 15-20% elastane. When a nylon/elastane/polyester blend is used, the uniform material construction preferably comprises 60-75% nylon, 10-20% elastane, and 15-30% polyester, most preferably 60-65% nylon, 10-15% elastane, and 20-25% polyester. In an alternative embodiment, the reusable elastic rash preventing insert (7) can be impregnated with a lotion or powder with moisturizing and/or antihistaminic properties. The reusable elastic rash preventing insert (7) may comprise one or more layers of the uniform material construction. When multiple layers of the uniform material construction are used, the layers can be attached to one another by any means known in the art, including sewing each layer to one another with thread. The reusable elastic rash preventing insert (7) absorbs sweat from the player's shin during play, provides comfort to the player, and prevents the formation of rashes.

Also illustrated in FIGS. 3-4 are attachment means (6B), which are secured to the reusable elastic rash preventing insert only in the vicinity of the longitudinal edges of the insert. Although the attachment means (6B) are depicted as two continuous strips in the vicinity of the longitudinal edges of the insert (7), the attachment means (6B) may also be formed with intermittent gaps in the attachment means in the vicinity of the longitudinal edges of the insert (7). That is, several portions of Velcro®, adhesive, or other attachment means may be secured in the vicinity of the longitudinal edges of the insert.

In the preferred embodiment, the attachment means (6B) are one side of a hook and loop (Velcro®) attachment means, wherein the other side of the hook and loop attachment means is attached to the backing layer of the shin guard portion (not pictured in FIG. 3). As noted above, although the attachment means (6B) is preferably a hook and loop (Velcro®) attachment means, other attachment systems, including, but not limited to, adhesive or clip-type attachment means, may be used. Where an adhesive attachment means is used, a removable protective liner is used to protect the adhesive prior to use. Moreover, embodiments are contemplated wherein no attachment means are required on the backing layer. Instead, the reusable elastic rash preventing insert may, for example, have adhesive attachment means secured to the insert that are applied directly to the backing layer.

Ultimately, when attachment means are used only in the vicinity of the longitudinal edges of the elastic rash preventing insert (7) and the backing layer (5), elasticity of the insert (7) and comfort to the player are maximized. Additional attachment means in the middle of the reusable elastic rash preventing insert (7) may be used, but such embodiments are less preferred because of the added rigidity imparted by additional attachment means.

Figure 5:
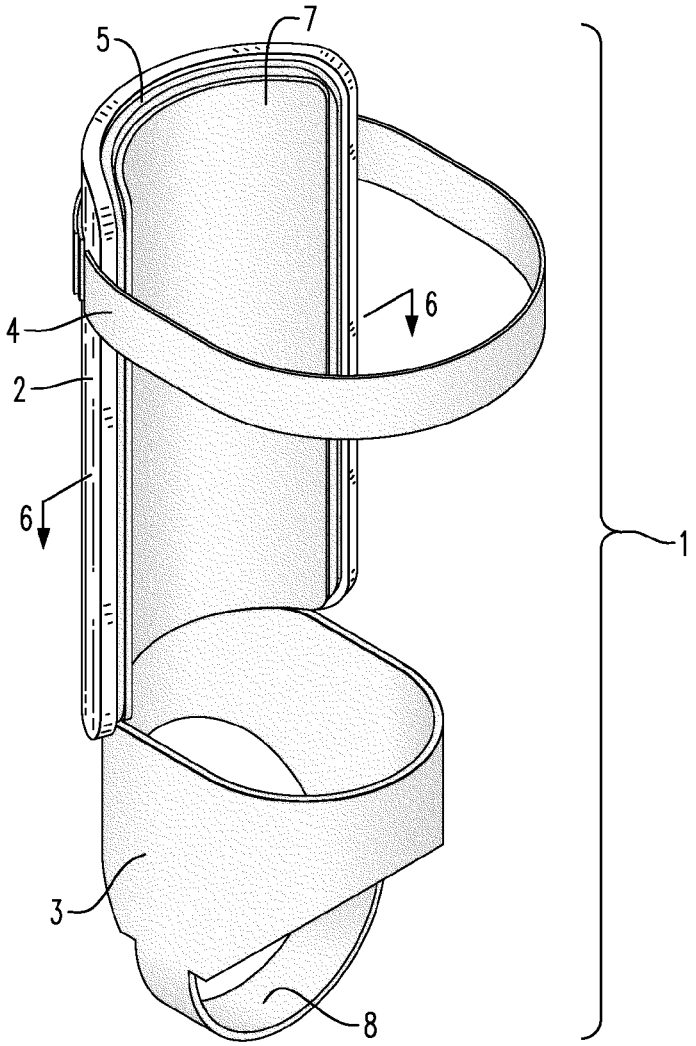
FIG. 5 is a back view of a preferred embodiment of a shin guard system including both a shin guard portion and a reusable elastic rash preventing insert.
Figure 6:
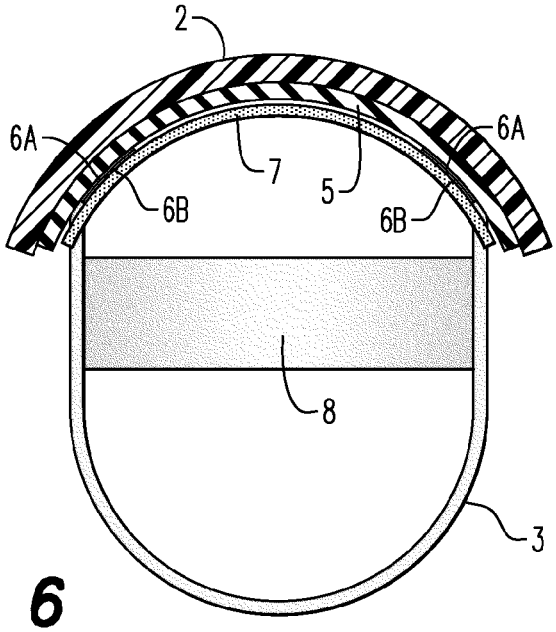
FIG. 6 is a top cross-sectional view of a shin guard system including both a shin guard portion and a reusable elastic rash preventing insert.

FIGS. 5-6 illustrate the shin guard system. FIG. 5 depicts the shin guard system from a rear view, while FIG. 6 is a cross-sectional view of the shin guard system looking down on the system towards the ankle protector (3). The shin guard system comprises a shin guard portion (1) with an impact absorbing layer (2) and a backing layer (5), wherein a reusable elastic rash preventing insert (7) is attached to the backing layer (5) via attachment means (6A, 6B). The shin guard system further comprises an integrated ankle protector (3). The attachment means (6A, 6B) are secured to the insert (7) and backing layer (5) only in the vicinity of the longitudinal edges of the insert (7) and backing layer (5), respectively. As can be seen in FIG. 5, the width of insert (7) is preferably sized to be equal to or less than the width of the back surface of the shin guard portion. Nonetheless, insert (7) will still function properly if the insert (7) extends beyond the longitudinal edges of the shin guard portion (1). The length of insert (7) is preferably sized to extend from the top of the shin guard to the top of the ankle protector (3). One of ordinary skill in the art would readily modify the width and length of insert (7) to fit any standard sized shin guard. The shin guard system also comprises an elastic leg strap (4) that allows the player to secure the shin guard portion (1) to the leg.

In use, a player will attach the reusable elastic rash preventing insert (7) to the backing layer (5) prior to securing the elastic leg strap (4) around his or her leg. Once the shin guard system (9) is secured to the player's leg, the player will pull a sock on over the top of the shin guard system (9). During play, the reusable elastic rash preventing insert (7) will absorb the sweat of the player and will provide a high degree of comfort such that the player does not develop rashes on the shin during play. Because the shin guard portion is secured to the player's leg via elastic leg strap (4), there is minimal risk of dislodgement from the player's shin during play, and the impact absorbing layer (2) and ankle protector (3) provide the necessary protection to the player throughout the game or match. Once the game or match has ended, the player can remove the removable elastic rash preventing insert (7) from the backing layer (5), and wash the insert (7) prior to the next game or match. As such, the integrity of the shin guard portion (1) is maintained throughout its life as there is no need to wash the shin guard portion (1) separately.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, any claims directed to the method and/or process of the present invention should not be limited to the performance of their steps in the order written, and one skilled in the art can readily appreciate that the sequences may be varied and still remain within the spirit and scope of the present invention.

The invention claimed is:

1. A shin guard system for sporting activities comprising:

a shin guard portion comprising an impact absorbing layer, a backing layer, and an elastic leg strap for securing the shin guard portion to a player's leg, and a reusable elastic rash preventing insert that is dimensioned and configured to be attached at or near the longitudinal edges of the backing layer of the shin guard portion, wherein the reusable elastic rash preventing insert is impregnated with a lotion or powder with moisturizing and/or antihistaminic properties.

2. The shin guard system as recited in claim 1, wherein the reusable elastic rash preventing insert comprises one or more layers formed of a nylon/elastane blend comprising 75-95% nylon and 5-25% elastane.

3. The shin guard system as recited in claim 1, wherein the reusable elastic rash preventing insert comprises one or more layers formed of a nylon/elastane/polyester blend comprising 60-75% nylon, 10-20% elastane, and 15-30% polyester.

4. The shin guard system as recited in claim 1, wherein the reusable elastic rash preventing insert comprises one or more layers formed of 100% polyester.

5. The shin guard system as recited in claim 1, wherein the shin guard portion additionally comprises an integrated ankle protector.

6. The shin guard system as recited in claim 1, wherein the elastic rash preventing insert attaches only at or near the longitudinal edges of the backing layer.

7. The shin guard system as recited in claim 1, wherein the width of the reusable elastic rash preventing insert is about equal to the width of the backing layer of the shin guard portion.

* * * * *